US006024508A

United States Patent [19]

Lippeth et al.

[11] Patent Number: 6,024,508

[45] Date of Patent: Feb. 15, 2000

[54] FOLIO HAVING FLIP-OVER PAD

[75] Inventors: Jeffrey S. Lippeth, Grays Lake; Robert J. Long, Lake-In-The Hills, both of Ill.

[73] Assignee: ACCO Brands, Inc., Lincolnshire, Ill.

[21] Appl. No.: 09/141,852

[22] Filed: Aug. 28, 1998

Related U.S. Application Data

[60] Provisional application No. 60/056,265, Aug. 29, 1997.

[51] Int. Cl.[7] ..... B42F 13/06; B42F 13/00; B42D 3/00

[52] U.S. Cl. ..... 402/73; 402/3; 402/14; 281/31; 281/19

[58] Field of Search ..... 402/3, 14, 73; 281/31, 19

[56] References Cited

U.S. PATENT DOCUMENTS

| | | | |
|---|---|---|---|
| 3,092,400 | 6/1963 | Smith | 281/19 |
| 4,892,333 | 1/1990 | Krulich | 281/29 |
| 5,351,992 | 10/1994 | Chilson et al. | 281/31 |
| 5,674,021 | 10/1997 | Hutnick | 281/37 |
| 5,711,627 | 1/1998 | Chapman | 402/3 |

*Primary Examiner*—Willmon Fridie, Jr.
*Assistant Examiner*—Mark T. Henderson
*Attorney, Agent, or Firm*—Pennie & Edmonds LLP

[57] ABSTRACT

A folio having a flip-over pad is disclosed. The folio has a front cover, a back cover, and, attached to the back cover, a pad holder into which a note pad or pad of paper may be inserted. The pad holder is configured such that the note pad can be stored between the front and back covers when the folio is closed and access to the pad is not needed or can extend around a front edge of the front cover to lay flat on the front cover when the folio is closed and access to the pad is desired. This configuration allows the folio to be in a normal closed position during use of the pad, rather than having the covers folded back in an extreme position with the cover outside surfaces facing each other.

17 Claims, 6 Drawing Sheets

FOLIO HAVING FLIP-OVER PAD

Priority of Provisional Application No. 60/056,265, filed on Aug. 29, 1997 is claimed under 35 U.S.C. §119(e).

FIELD OF THE INVENTION

The present invention is directed to a folio such as a binder or notebook, with a pad holder attached to a cover to hold a note pad.

BACKGROUND OF THE INVENTION

Binders capable of holding a note pad or pad of paper are known in the art. Typically, the pad is inserted into a pocket on the inside of either the front or back cover of the binder. As a result, if a user needs to use the pad with the binder in a manageable position, either the front or back cover must be bent back in an extreme position until the outsides of the covers contact each other. Such bending can cause significant wear and tear of the binder and makes using the pad awkward and inconvenient. In addition, any other papers stored inside the binder would be exposed and subject to damage or loss.

One portfolio, described in U.S. Pat. No. Des. 267,653 to Miller et al., is a combined portfolio and writing pad with a pad holder located on a third panel. The third panel is shown having a similar construction to the front and back covers except it has a slit for holding a pad. Constructing the third panel like the front and back covers increases the cost of manufacturing the portfolio. Furthermore, a hinge portion at the junction between the third panel and the back cover is not large enough so that the third panel lies flat on top of the front cover when the front and back covers are closed. As a result, even if the writing pad were accessible when the front and back covers are closed, the writing pad would be oriented at an awkward angle with respect to the surfaces of the front and back covers, making writing on the pad difficult. Finally, the configuration of the slit allows the insertion of only one pad and requires that the pad b inserted in a specific orientation.

U.S. Pat. No. 5,277,451 to Garza discloses an information pad for checkbooks. The information pad has a slotted member affixed to a checkbook cover. A slot in the slotted member receives an information receiving pad. As is the case wit the '653 patent discussed above, the slot requires that the information receiving pad be inserted in a specific orientation. Furthermore, a seam weld between the checkbook cover and the slotted member is not long enough so that the slotted member and information receiving pad can lay flat on the checkbook cover when the checkbook cover is closed.

Thus, there exists a need for a folio that has a flip-over pad which lays flat on the folio when the folio is closed.

SUMMARY OF THE INVENTION

The folio according to the present invention includes a front cover, a back cover pivotably connected to the front cover, and a pad holder pivotably connected to the folio. The pad holder is configured to receive at least a portion of a pad of paper and is pivotable to a first position between the front and back covers when the folio is closed. The pad holder is also pivotable to a second position on top of the front cover, again when the folio is closed. The configuration of the folio permits the covers of the folio to be in a normal closed position during use of the pad, without requiring that the covers be folded backwards to an extreme position in which the outsides of the covers contact each other.

DESCRIPTION OF THE PREFERRED EMBODIMENTS

Figure 1:
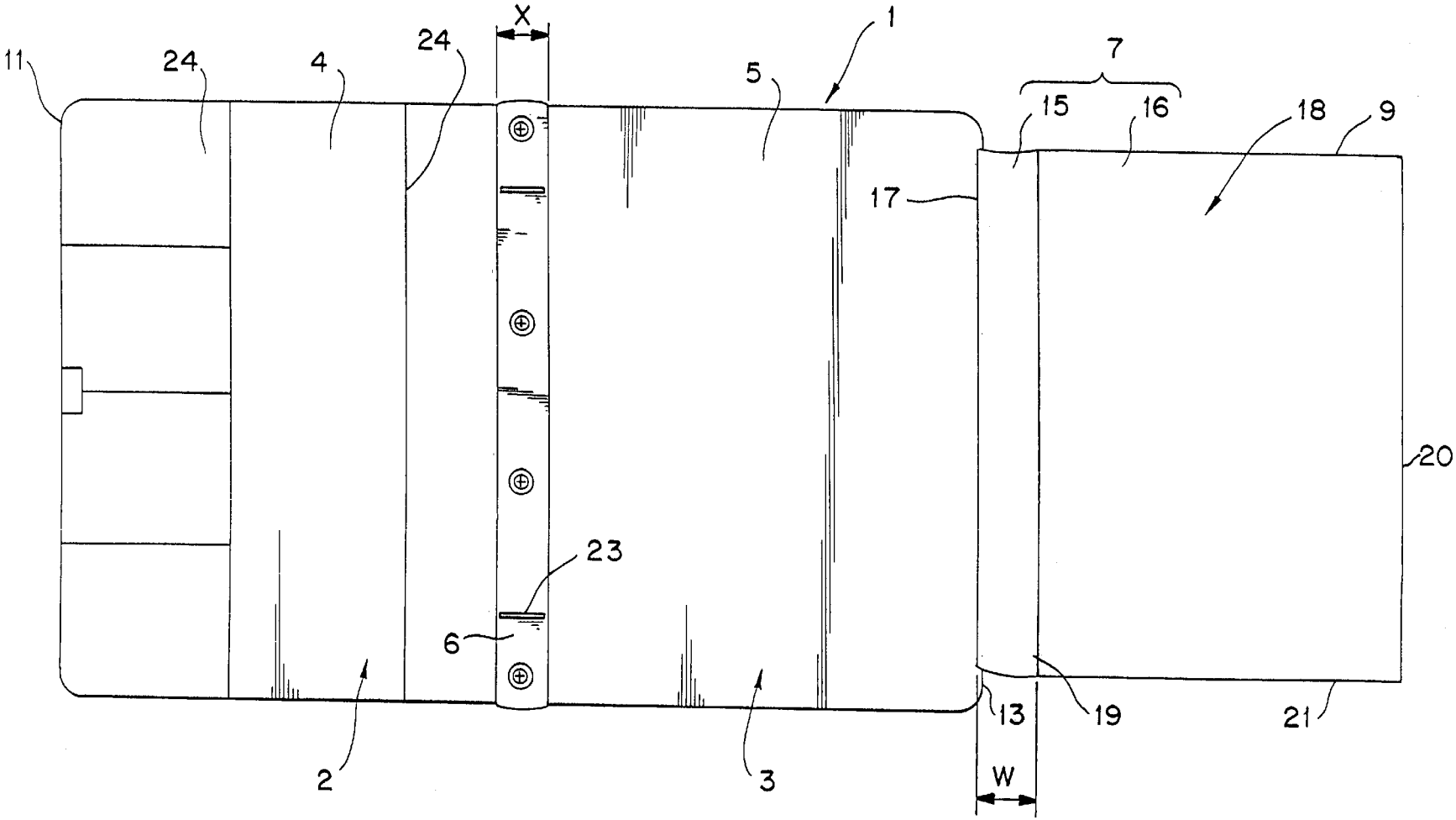
FIG. 1 is a front elevational view of a first embodiment of a folio according to the present invention with the folio open and the pad holder extended outward from the folio.

Referring primarily to FIG. 1, folio 1 has a front cover 2 pivotably connected to a back cover 3. As used herein, the term "folio" includes notebooks, folders, and other binder-type holders. Front and back covers 2, 3 are of identical or similar construction and are preferably made of a rigid core material such as a hard plastic or cardboard surrounded by a flexible covering such as a soft plastic, fabric, or leather.

Figure 3:
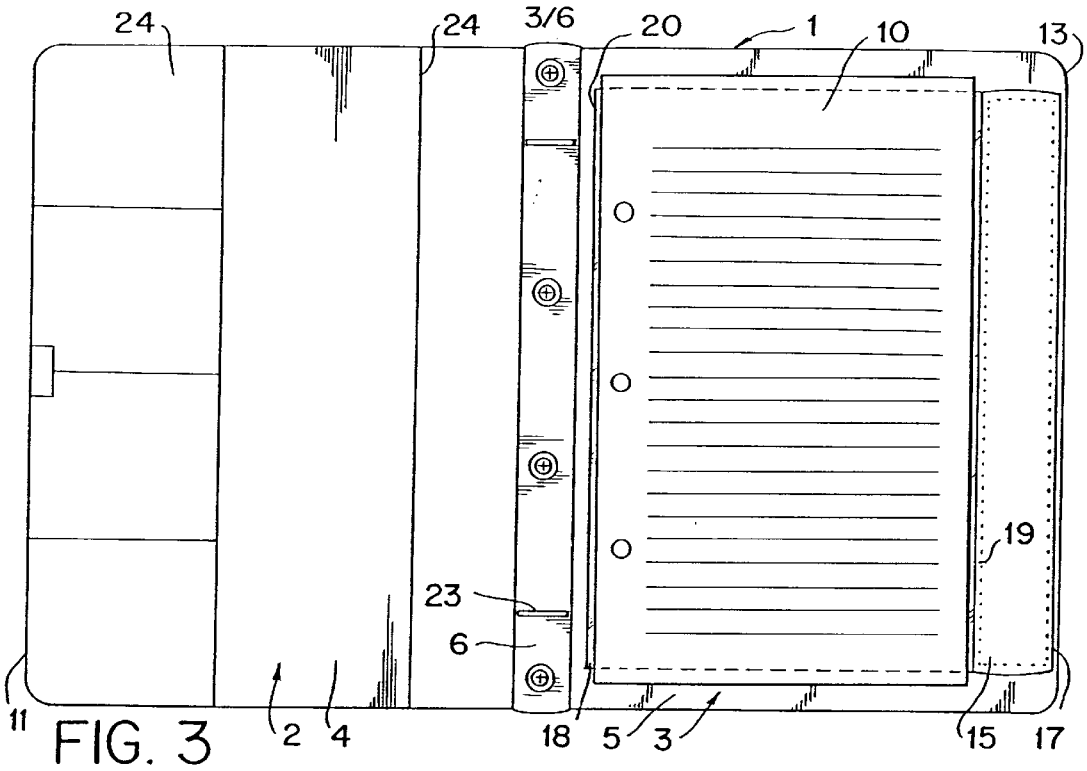
FIG. 3 is a front elevational view thereof with the folio open and the pad holder located on the inner surface of the back cover with a note pad in the pad holder.
Figure 4:
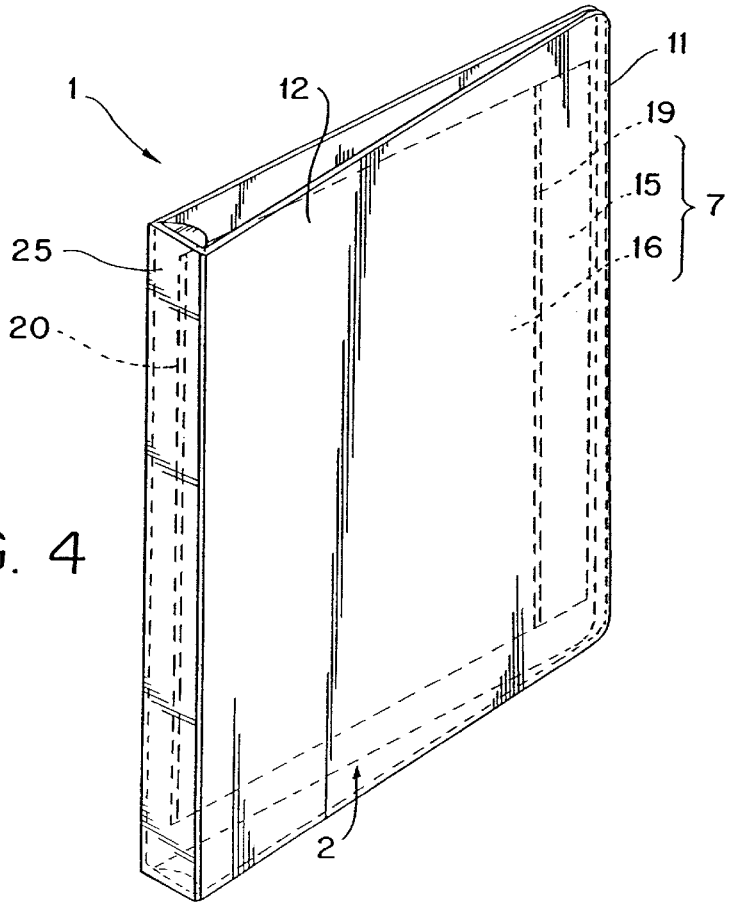
FIG. 4 is a perspective view thereof with the folio closed and the pad holder located between the front and back covers.
Figure 5:
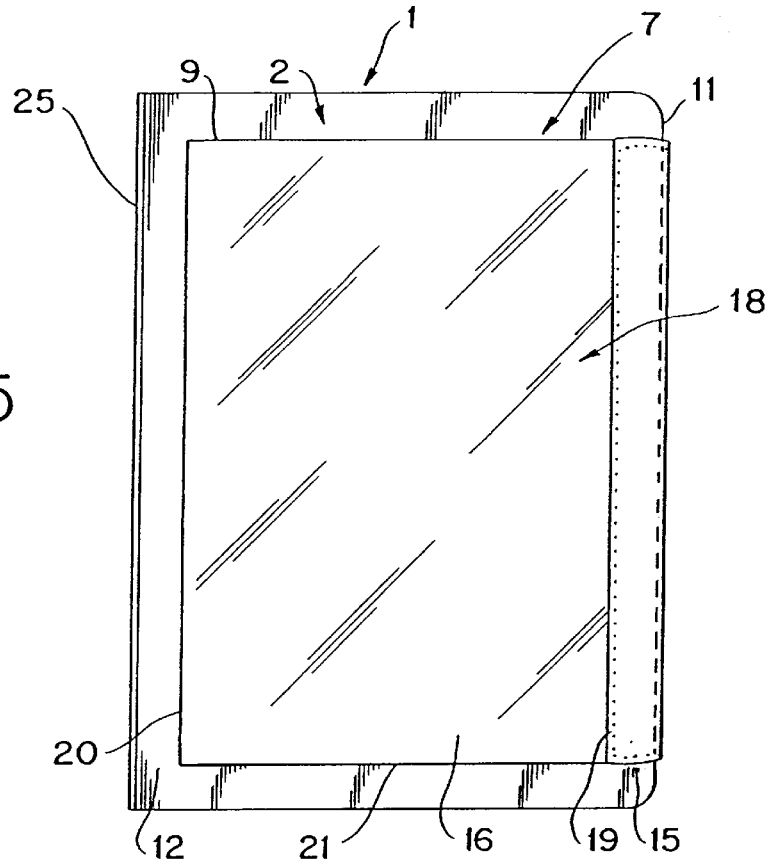
FIG. 5 is a front elevational view with the pad holder on top of the front cover of the closed folio.
Figure 6:
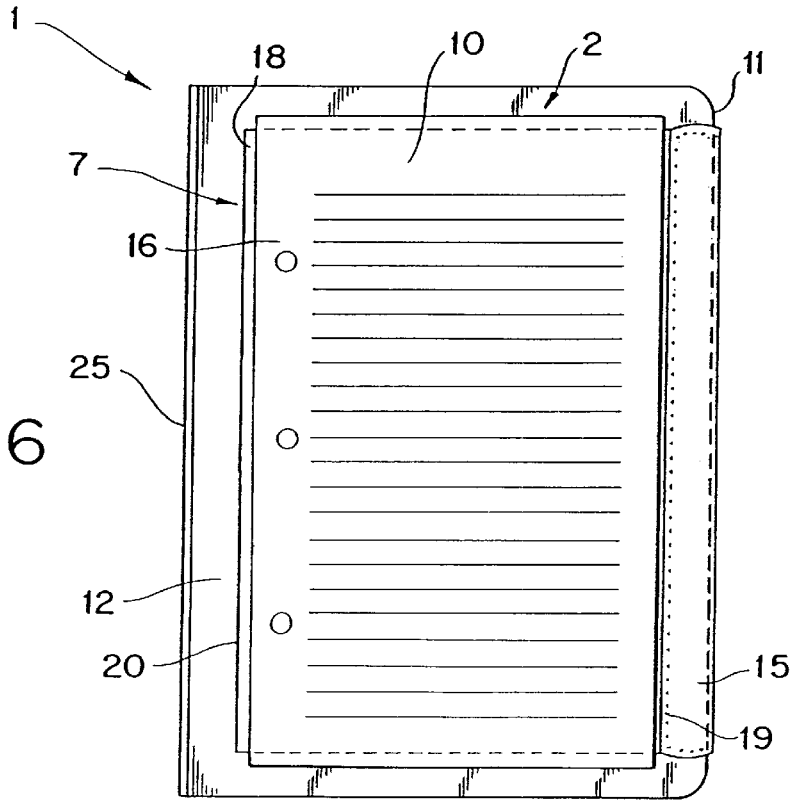
FIG. 6 is a front elevational view with a pad fitted in the pad holder, which is top of the front cover of the closed folio.

Because front and back covers 2, 3 are pivotably connected, front and back covers 2, 3 can move from a closed position with their respective inner surfaces 4, 5 facing each other, as shown in FIGS. 4–6, to an open position with inner surfaces 4, 5 substantially lying in the same plane, as shown in FIGS. 1 and 3. A spine 6 preferably pivotably connects front and back covers 2, 3. Other manners of pivotably connecting front and back covers 2, 3 include the use of a spiral wire or providing a folding region between front and back covers 2, 3, the folding region having greater flexibility than the rest of front and back covers 2, 3.

Figure 2:
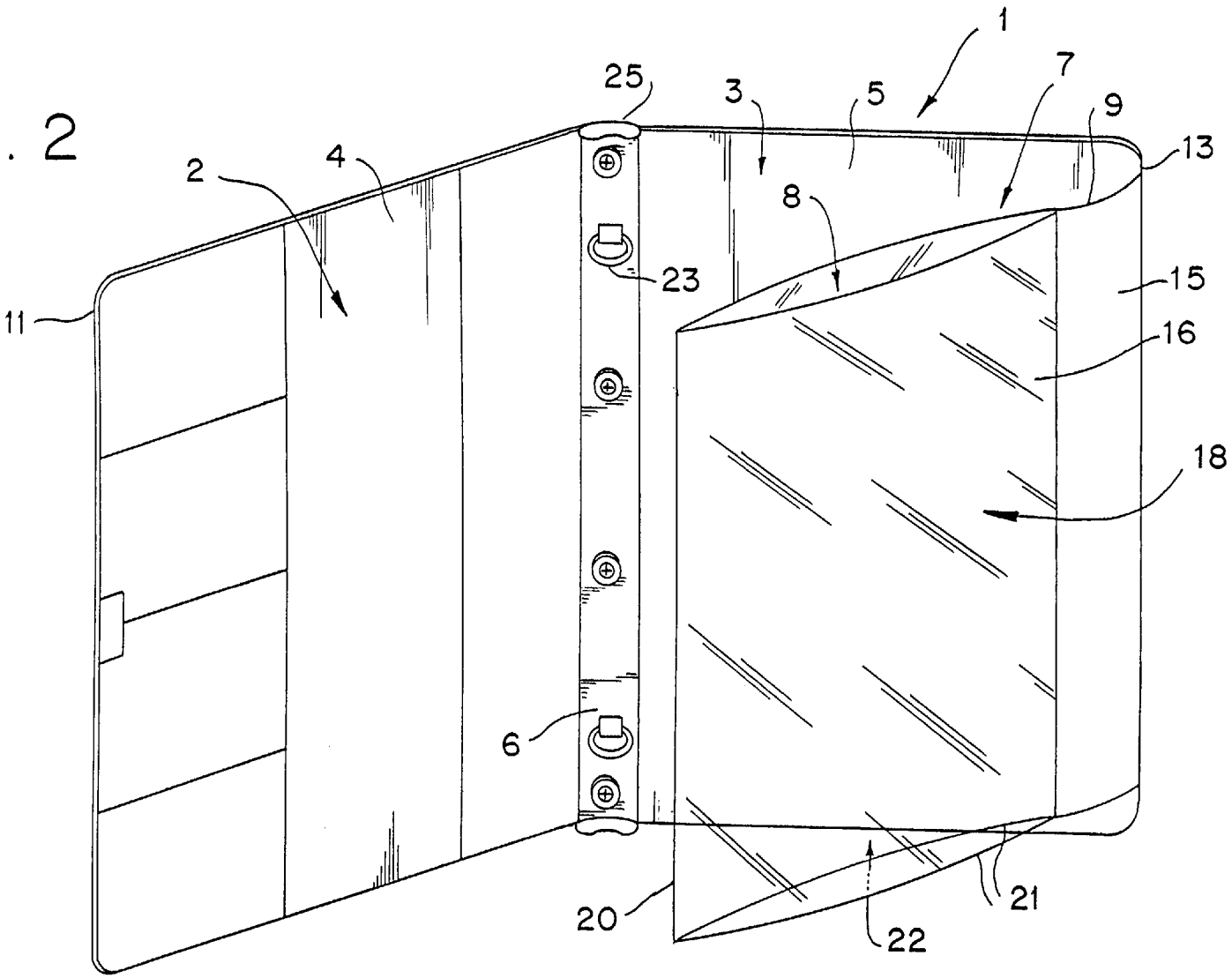
FIG. 2 is a perspective view thereof with the folio partially open.

A pad holder 7 is pivotably connected to back cover 3 of folio 1. Referring to FIGS. 2, 3, and 6, pad holder 7 has an opening 8 on a top edge 9 into which a note pad or pad of paper 10 may be inserted. Other manners of attaching note pad 10 to pad holder 7 include the use of an adhesive, a clip, or other fastener. Typically, only a portion of note pad 10, e.g. the cardboard backing usually found on pads of paper, is inserted in opening 8. However, opening 8 can accommodate all of note pad 10 so that pad holder 7 is covering all of note pad 10, and thus protecting the entirety of note pad 10. In a preferred embodiment, pad holder 7 is made of a transparent or translucent material so that the portions of note pad 10 in opening 8 can be viewed. As opening 8 is located on top edge 9 of pad holder 7 rather than merely a slit on the surface of pad holder 7, note pad 10 can be inserted in opening 8 facing either forward as seen in FIGS. 3 and 6, or backwards. Alternatively, two notepads, one facing forward and one facing backward, can be inserted in opening 8.

Pad holder 7 is configured such that it is movable between three positions in addition to the fully extended position of FIG. 1. In a first position shown in FIG. 3, pad holder 7 lays substantially flat against inner surface 5 of back cover 3. Thus, as shown in FIG. 4, pad holder 7 and note pad 10 are located between front and back covers 2, 3 when folio 1 is closed.

In a second position shown in FIGS. 5 and 6, pad holder 7 is folded around an edge 11 of front cover 2 of folio 1 so that note pad 10 is placed substantially flat on an outer surface 12 of front cover 2 when folio 1 is closed. This configuration allows folio 1 to be in a normal, closed position during use of note pad 10, rather than having the cover folded 180° in an extreme position, leaving the interior of folio 1 exposed. Thus, using note pad 10 when folio 1 is in the closed position is not awkward or inconvenient and does not result in unnecessary wear and tear of folio 1.

Figure 7:
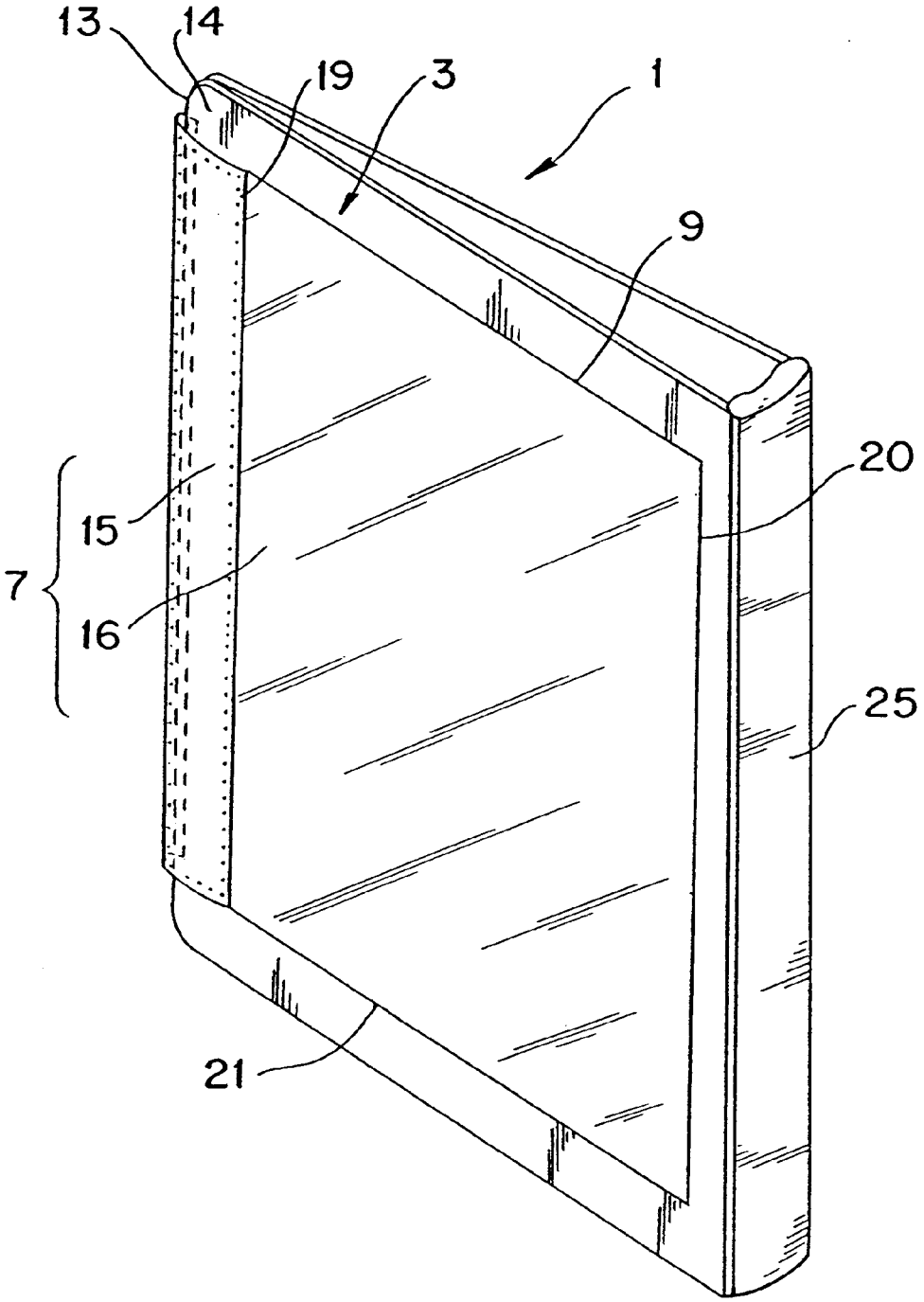
FIG. 7 is a back elevational view with the pad holder on top of the back cover of the closed folio.

In a third position, shown in FIG. 7, pad holder is folded around an edge 13 of back cover 3 of folio 1 so that note pad 10 is placed substantially flat on an outer surface 14 of back cover 3 when folio 1 is closed. This configuration is particularly useful if the user wishes to move pad holder off of front cover 2 when folio 1 is closed without having folio 1 totally extended as in FIG. 1. Additionally, the third position permits access to items located behind pad holder 7 when pad holder 7 is in the second position and folio 1 is open without the necessity of having folio 1 totally extended. This configuration also provides access to notepads placed back to back in opening 8 by flipping pad holder 7 between the second and third positions.

Pad holder 7 is of two-piece construction in the preferred embodiment. The first piece is an extension member 15 disposed between pad holder 7 and back cover 3 and the second piece is a body member 16 which has opening 8 for receiving note pad 10. Extension member 15 is preferably attached to inner surface 5 of back cover 3, but in an alternative embodiment is attached to outer surface 14. Extension member 15 has width, W, that is sufficient to allow body member 16 to lay on top of front cover 2 when folio 1 is in the closed position. Width W is preferably wider than width X of spine 6. In a further embodiment, extension member 15 is a leather strip sewn to an inside portion 17 of inner surface 5 of back cover 3, and body member 16 consists of two clear plastic sheets 18 or a single sheet folded in half attached to extension member 15 along a first long edge 19 and attached to one another along a second long edge 20 so the desired portion of note pad 10 can slide in opening 8 formed between plastic sheets 18.

Plastic sheets 18 are flexible so that if outer surface 12 of front cover 2 and/or outer surface 14 of back cover 3 has any curvature, pad holder 7 will substantially conform to the curvature. As previously discussed, the forming of body member 16 from a transparent or translucent material allows viewing of the portion of note pad 10 that is inside opening 8. Thus, pad holder 7 protects the part of note pad 10 contained within opening 8 from inclement weather when folio 1 is closed with pad holder 7 in the second or third positions yet still permits visualization of the portion of note pad 10 that is inside opening 8. It is also important to note that in the preferred embodiment, plastic sheets 18 are not attached along a bottom edge 21 so that note pad 10 can be inserted through an opening 22 along bottom edge 21 if desired. If folio 1 is turned upside down with notepad 10 in opening 22, folio 1 and notepad 10 are now oriented for use by left-handed people.

Preferably, folio 1 has binder assembly attachment rings 23 inside folio 1 along spine 6 between front and back covers 2, 3. Binder assembly attachment rings 23 cooperate with a binder mechanism to releasably hold papers. In an alternative embodiment, the binder attachment assembly comprises rivets to fasten a binder assembly to the folio. Folio 1 preferably also has a variety of pockets 24 inside front and back covers 2, 3 to hold pens, note cards, business cards, computer disks, or any other materials that are normally carried in a folio. Additionally, the preferred embodiment has an attachable rubber boot 25 along an outside surface of spine 6 to provide support and protect spine 6 from excessive wear without interfering with the opening and closing of folio 1.

Figure 8:
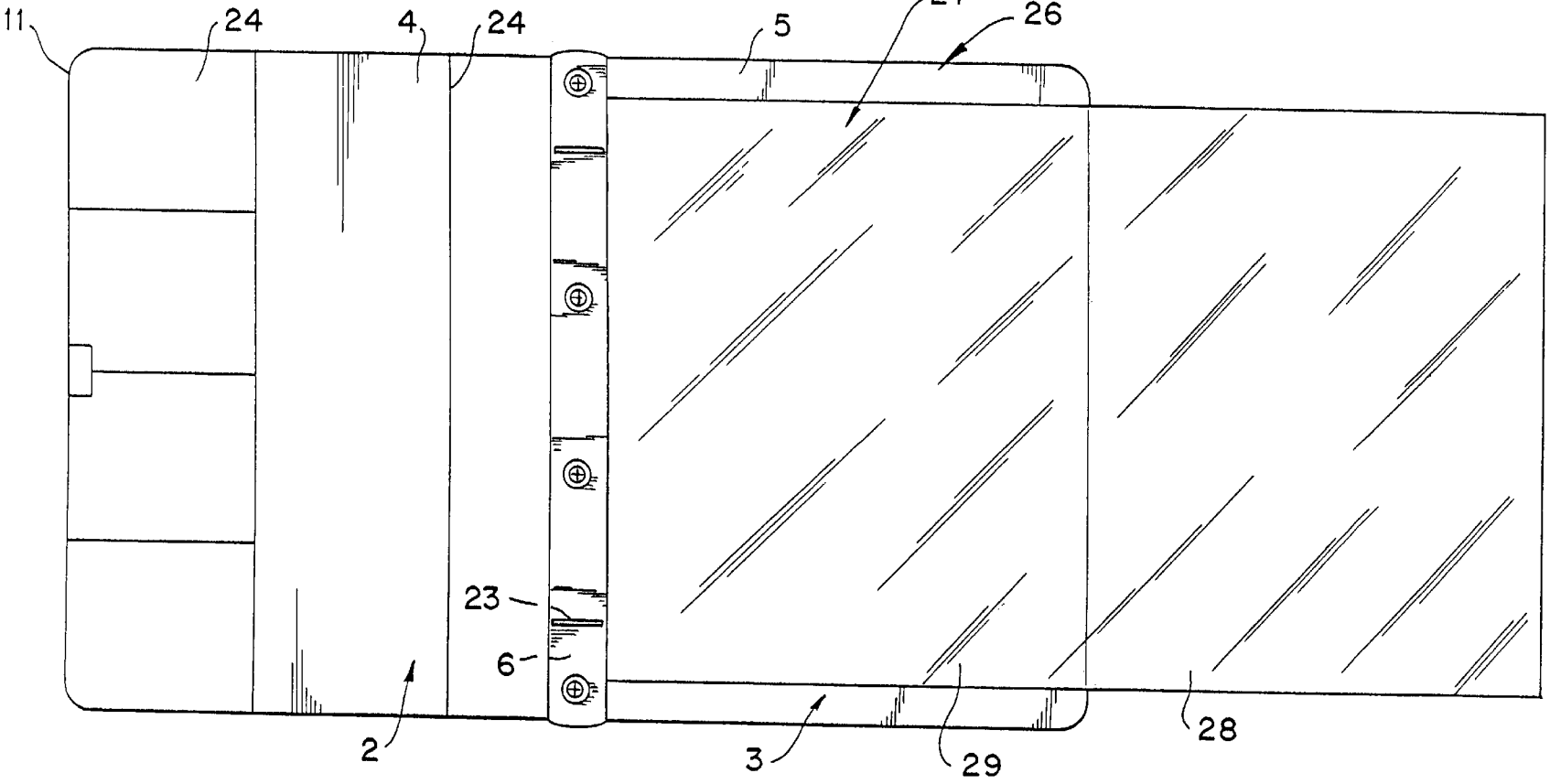
FIG. 8 is a front elevational view of a second embodiment of a folio according to the present invention with the folio open and the pad holder extended outward from the folio.

A second embodiment of a folio 26 according to the present invention is shown in FIG. 8. In general, most of the structure shown in FIG. 8 is like or comparable to the structure illustrated in the embodiment shown in FIGS. 1 through 7, and according discussion of those like components is not believed necessary. A pad holder 27 is connected to folio 26 in the area between front and back covers 2, 3. Pad holder 27 has a first portion 28 and a second portion 29. Note pad 10 is attached to first portion 28 using any of the previously described means. Pad holder 27 is approximately twice as wide as back cover 3 and is made of a flexible material so that first portion 28 can be bent on top of second portion 29. This allows pad holder 27 to be in first position, i.e. laying substantially flat against inner surface 5 of back cover. The length and flexibility of pad holder 27 also permits placement of pad holder 27 in the second or third positions. As an alternative to making pad holder 27 entirely out of a flexible material, the region between first and second portions 28, 29 is flexible to allow movement of pad holder 27 to the first, second, and third positions.

While it is apparent that the illustrative embodiments of the invention herein disclosed fulfill the objectives stated above, it will be appreciated that numerous modifications and other embodiments may be devised by those skilled in the art. Therefore, it will be understood that the appended claims are intended to cover all such modifications and embodiments which come within the spirit and scope of the present invention.

What is claimed is:

1. A folio comprising:

(a) a first cover having inner and outer surfaces;

(b) a second cover pivotably connected to the first cover and having an inner surface;

(c) a pad holder pivotably connected to the folio and configured and dimensioned to receive at least a portion of a pad of paper; and (d) an extension member connecting the pad holder to the second cover and having a width sufficient to allow the pad holder to lay substantially flat against the outer surface of the first cover, wherein the pad holder is pivotable with respect to the folio between:

(i) a first position between the first and second covers when the folio is in a closed position in which the inner surfaces of the first and second covers face each other, and (ii) a second position when the folio is in the closed position with the pad holder laying substantially flat against the outer surface of the first cover with at least a part of the pad of paper visible, and wherein the pad holder comprises at least two sheets, each of the sheets having:

(i) a first edge attached to the extension; and (ii) a second edge parallel to the first edge, the second edges of each sheet being affixed to each other to define a first opening between the sheets alone a third edge of the pad holder for receiving at least a portion of the pad of paper.

2. The folio of claim 1 wherein at least one of the sheets is made of a transparent or translucent material.

3. The folio of claim 1 wherein the pad holder has a second opening along a fourth edge of the pad holder configured and dimensioned to receive the at least a portion of a pad of paper.

4. The folio of claim 3 wherein the fourth edge is disposed on an opposite side of the pad holder from the third edge.

5. The folio of claim 1 wherein the pad holder is attached to the inside surface of the second cover.

6. The folio of claim 1 wherein at least one of the covers has at least one storage pocket.

7. The folio of claim 1 further comprising a spine disposed between the first and second covers and pivotably connected at a first end to the first cover and pivotably connected at a second end to the second cover.

8. The folio of claim 7 further comprising a rubber boot attached to an outside surface of the spine to protect the spine.

9. The folio of claim 7 wherein the spine comprises a rigid material.

10. The folio of claim 1 further comprising a binder attachment for attaching a binder assembly thereto for removably securing paper between the covers.

11. The folio of claim 1 wherein the first and second covers are at least semi-rigid material.

12. The folio of claim 1 wherein the pad holder is flexible.

13. The folio of claim 1 wherein:

(a) the second cover has an outside surface; and (b) the pad holder is pivotable to a third position substantially against the outside surface of the second cover when the folio is in the closed position.

14. A folio comprising:

(a) a first cover;

(b) a second cover;

(c) a spine pivotably connected at a first end to the first cover and pivotably connected to a second end to the second cover;

(d) a pad holder having an opening along a top edge to receive at least a portion of at least one pad of paper; and (e) an extension member pivotably connected to the second cover at a first end, pivotably connected to the pad holder at a second end, and configured and dimensioned to extend around a front edge of the first cover so that the pad holder lays substantially flat on the first cover when a pad is inserted into the pad holder and the folio is in a closed position with interior surfaces of the first and second covers facing each other.

15. The folio of claim 14 wherein:

(a) the spine has a spine width between the first and second covers; and (b) the extension member has an extension width that is wider than the spine width.

16. The folio of claim 1 wherein at least a portion of the pad holder lies between the first cover and the part of the pad of paper when the pad holder is in the second position.

17. A folio comprising:

(a) a first cover having inner and outer surfaces;

(b) a second cover pivotably connected to the first cover and having an inner surface; and (c) a pad holder pivotably connected to the folio at a spaced distance from the first cover and configured and dimensioned to receive at least a portion of a pad of paper, wherein the pad holder is pivotable with respect to the folio between:

(i) a first position between the first and second covers when the folio is in a closed position in which the inner surfaces of the first and second covers face each other and a front side of pad of paper and the inner surface of the second cover both face in a first direction, and (ii) a second position when the folio is in the closed position with the pad holder laying substantially flat against the outer surface of the first cover and a front side of the pad of paper facing in the first direction.

* * * * *

UNITED STATES PATENT AND TRADEMARK OFFICE
CERTIFICATE OF CORRECTION

PATENT NO. : 6,024,508

DATED : February 15, 2000

INVENTOR(S) : LIPPETH *et al.*

It is certified that error appears in the above-identified patent and that said Letters Patent is hereby corrected as shown below:

TITLE PAGE [75] Inventors: change "Jeffrey S. Lippeth" to --Jeffery S. Lippeth--.

Col. 5, line 1, change "alone" to --along--.

Signed and Sealed this

Fifth Day of December, 2000

*Attest:*

*Attesting Officer*

Q. TODD DICKINSON

*Director of Patents and Trademarks*